US011402173B1

(12) United States Patent
Wiggins et al.

(10) Patent No.: US 11,402,173 B1
(45) Date of Patent: Aug. 2, 2022

(54) RETENTION SYSTEM

(71) Applicant: BOWDEN TACTICAL, LLC, Willoughby, OH (US)

(72) Inventors: James Wiggins, Rome, OH (US); Kurt Horvath, Fayetteville, TN (US)

(73) Assignee: BOWDEN TACTICAL, LLC, Willoughby, OH (US)

( * ) Notice: Subject to any disclaimer, the term of this patent is extended or adjusted under 35 U.S.C. 154(b) by 0 days.

(21) Appl. No.: 17/153,568

(22) Filed: Jan. 20, 2021

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01)

(58) Field of Classification Search
CPC ..... F41C 23/16; F41A 21/48
USPC ..... 42/75.02, 75.03, 75.1, 71.01, 90
See application file for complete search history.

(56) References Cited

U.S. PATENT DOCUMENTS

| | | | | |
|---|---|---|---|---|
| 7,104,000 | B2 | 9/2006 | Orth | |
| 8,234,808 | B2 | 8/2012 | Lewis et al. | |
| 8,689,478 | B2 | 4/2014 | Patel | |
| 8,819,980 | B2 * | 9/2014 | Geissele | F41C 23/16 42/75.01 |
| 9,157,697 | B2 | 10/2015 | Leclair | |
| 9,453,694 | B1 * | 9/2016 | Storch | F41A 3/64 |
| 9,464,865 | B2 | 10/2016 | Shea et al. | |
| 9,494,382 | B2 | 11/2016 | Storch | |
| 9,528,793 | B1 * | 12/2016 | Oglesby | F41C 27/00 |
| 9,599,430 | B1 * | 3/2017 | Geissele | F41C 23/16 |
| 10,126,095 | B1 | 11/2018 | Reid | |
| 10,145,648 | B1 | 12/2018 | Holder et al. | |
| 10,274,283 | B1 | 4/2019 | Oglesby | |
| 10,345,075 | B1 | 7/2019 | Oglesby | |
| 10,352,650 | B2 | 7/2019 | Hiler, Jr. et al. | |
| 10,436,549 | B1 | 10/2019 | Taylor et al. | |
| 10,480,890 | B2 | 11/2019 | Battaglia et al. | |
| 10,527,386 | B2 | 1/2020 | Faxon | |
| 2006/0053673 | A1 | 3/2006 | Murello | |
| 2013/0180151 | A1 | 7/2013 | Moore | |
| 2014/0130390 | A1 * | 5/2014 | Geissele | F41C 23/16 42/71.01 |
| 2014/0373419 | A1 * | 12/2014 | Leclair | F41C 23/16 42/71.01 |
| 2016/0209162 | A1 * | 7/2016 | Geissele | F41C 23/02 |
| 2016/0282083 | A1 * | 9/2016 | Storch | F41A 11/00 |
| 2017/0059273 | A1 * | 3/2017 | Geissele | F41C 23/16 |
| 2017/0299326 | A1 * | 10/2017 | Seekins | F41A 21/482 |
| 2018/0202759 | A1 | 7/2018 | Samson et al. | |

(Continued)

*Primary Examiner* — Jonathan C Weber
(74) *Attorney, Agent, or Firm* — Rankin, Hill & Clark LLP

(57) ABSTRACT

A handguard assembly includes a handguard and a key. The handguard includes a receiver surface that faces toward a receiver of an associated firearm and a muzzle surface that faces toward a muzzle of an associated barrel of the associated firearm and in an opposite direction as the receiver surface. The handguard extends between the receiver surface and the muzzle surface so as to define a longitudinal direction. The handguard defines a key bore extending in the longitudinal direction from the receiver surface toward the muzzle surface. The key is received in the key bore of the handguard so as to be surrounded by the handguard such that the key is concealed from view when the handguard is installed on the associated firearm.

20 Claims, 8 Drawing Sheets

(56) References Cited

U.S. PATENT DOCUMENTS

2018/0306551 A1* 10/2018 Reid ..... F41A 21/485
2019/0170476 A1* 6/2019 Hiler, Jr. ..... F41A 21/482

* cited by examiner

RETENTION SYSTEM

BACKGROUND

Handguards are utilized on many types of firearms for a variety of reasons. Handguard can provide for an improved grip for the user of the firearm. Further, the handguard also provides protection to the user, by isolating some of the heat that can be generated by a barrel during operation of the firearm. Further still, the handguard can provide for an attachment area for one or more accessories, which could include an optical sight, illumination device, or additional weaponry, or other items.

The handguard can be attached to the firearm in a variety of ways. Although the typical methods of connection usually work adequately, the number of visible fasteners and associated components detracts from the appearance, operation, and performance of the firearm. Thus, a better handguard assembly is needed.

SUMMARY

In view of the foregoing, a handguard assembly is provided that includes a handguard and a key. The handguard includes a receiver surface that faces toward a receiver of an associated firearm and a muzzle surface that faces toward a muzzle of an associated barrel of the associated firearm and in an opposite direction as the receiver surface. The handguard extends between the receiver surface and the muzzle surface so as to define a longitudinal direction. The handguard defines a key bore extending in the longitudinal direction from the receiver surface toward the muzzle surface. The key is received in the key bore of the handguard so as to be surrounded by the handguard such that the key is concealed from view when the handguard is installed on the associated firearm.

DETAILED DESCRIPTION

Figure 1:
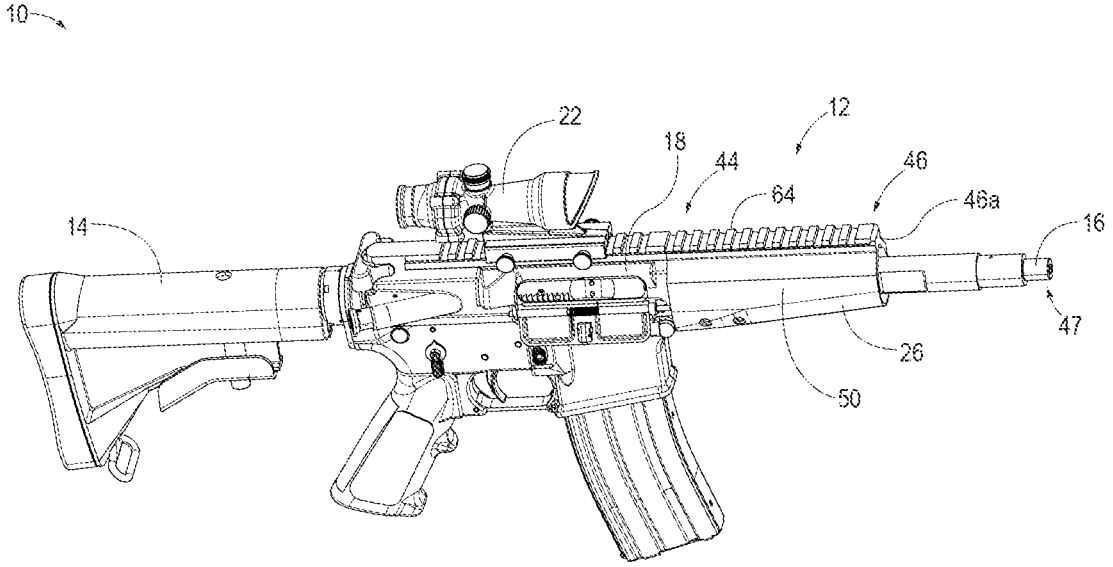
FIG. 1 is a side perspective view of a firearm with a handguard assembly.
Figure 2:
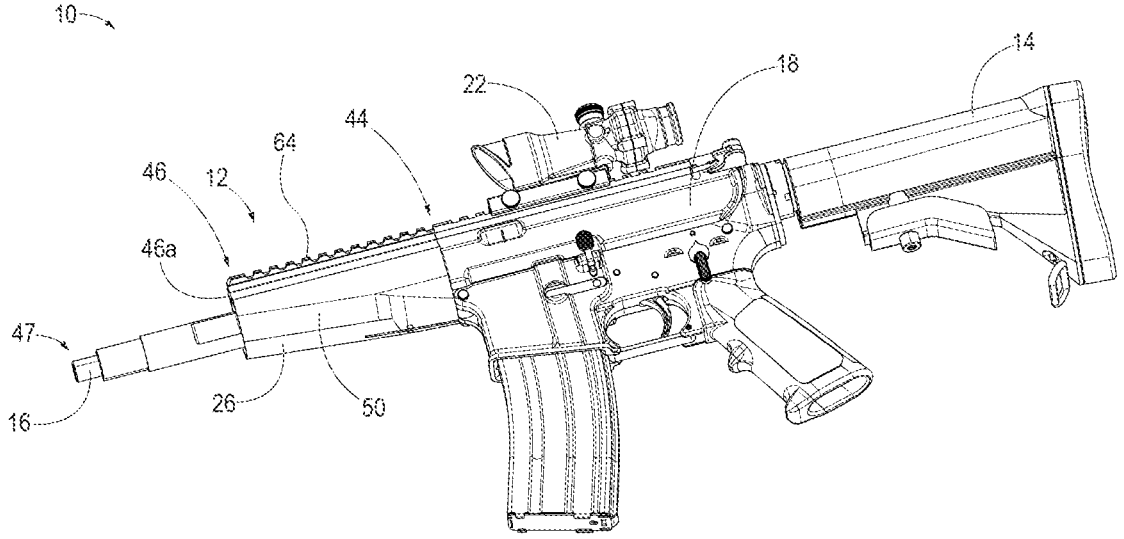
FIG. 2 is an opposite perspective view of a firearm with a handguard assembly.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-2 schematically depict a firearm 10 according to the present disclosure.

The term "firearm" is used to denote any type of weapon that discharges projectiles. It will be appreciated that the firearm 10 could be any number of configurations without departing from the scope of this disclosure. As illustrated, the firearm 10 is a semi-automatic rifle that can be magazine fed. The basic operation of the firearm 10 is well understood, and a detailed explanation thereof is not necessary for an understanding of the present invention.

The firearm 10 generally includes a handguard assembly 12, a stock 14, a barrel 16, a receiver 18, and an accessory 22. The stock 14 is disposed at a rear end of the firearm and the barrel 16 is disposed at a front end of the firearm 10, with the receiver 18 disposed therebetween. As shown, the accessory 22 is a reflector type sight (e.g., a red dot sight).

Figure 3:
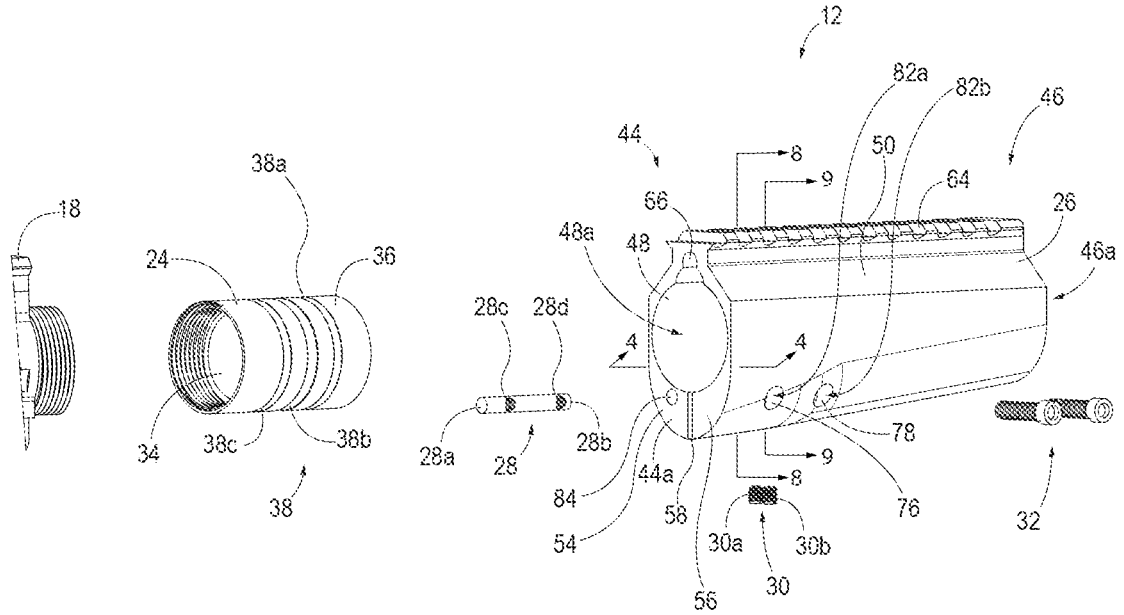
FIG. 3 is an exploded perspective view of the handguard assembly.
Figure 4:
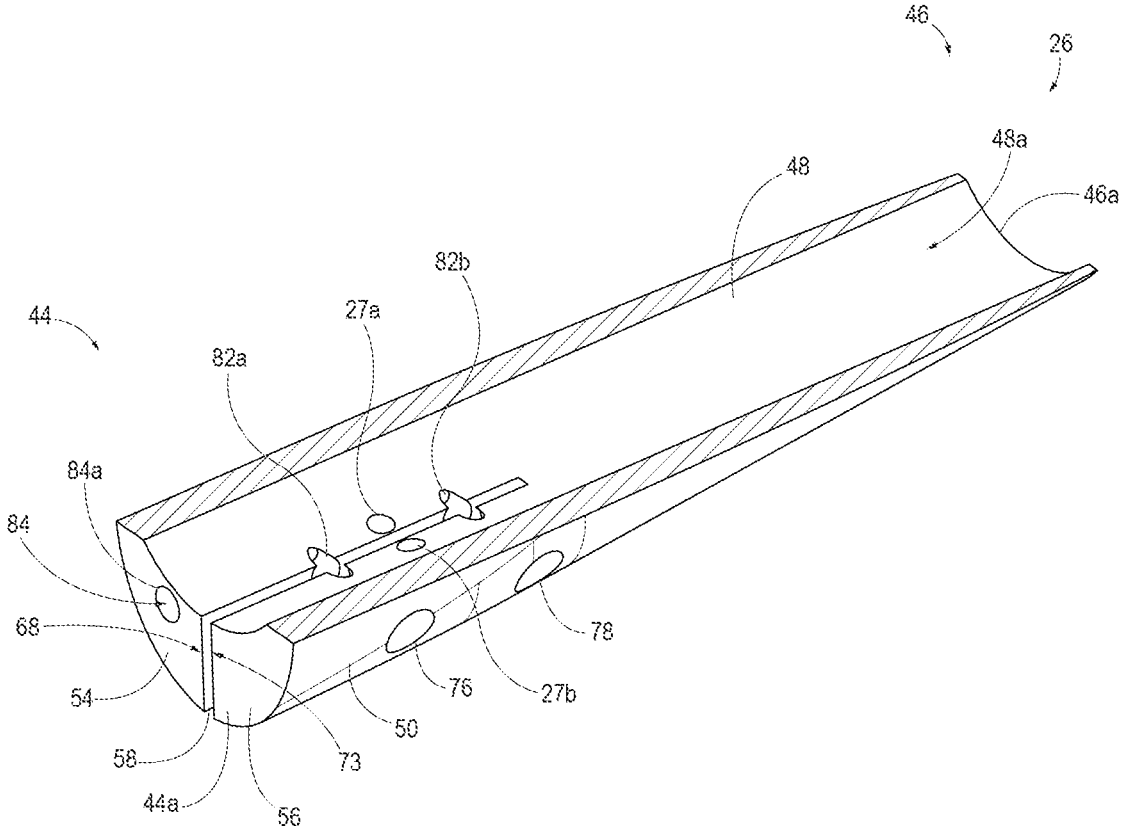
FIG. 4 is a sectional perspective view of FIG. 3 along line 4-4.
Figure 5:
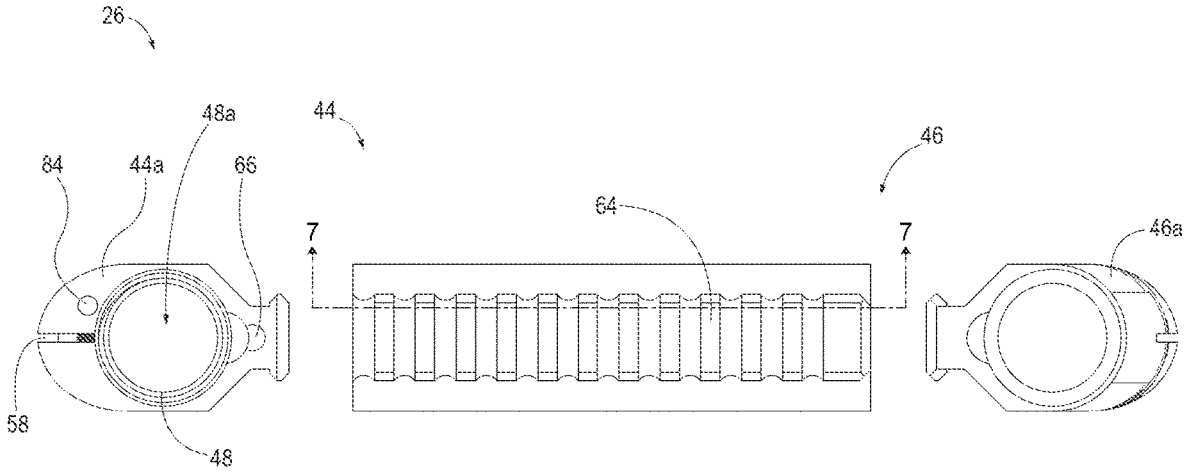
FIG. 5 is a top plan interrupted view of a handguard of the handguard assembly.
Figure 6:
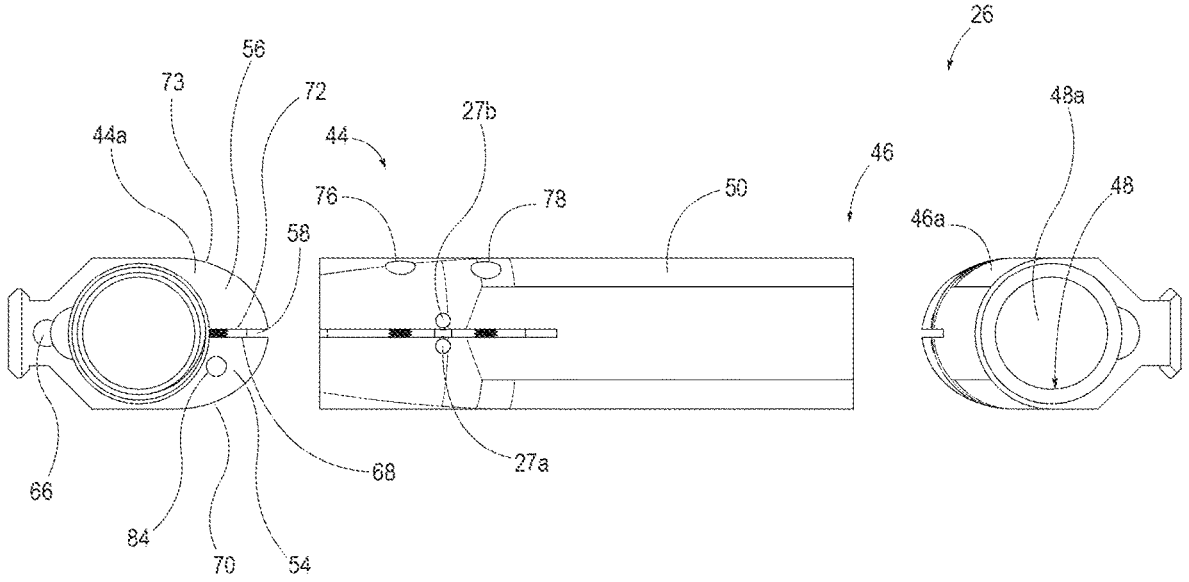
FIG. 6 is a bottom plan interrupted view of a handguard of the handguard assembly.
Figure 7:
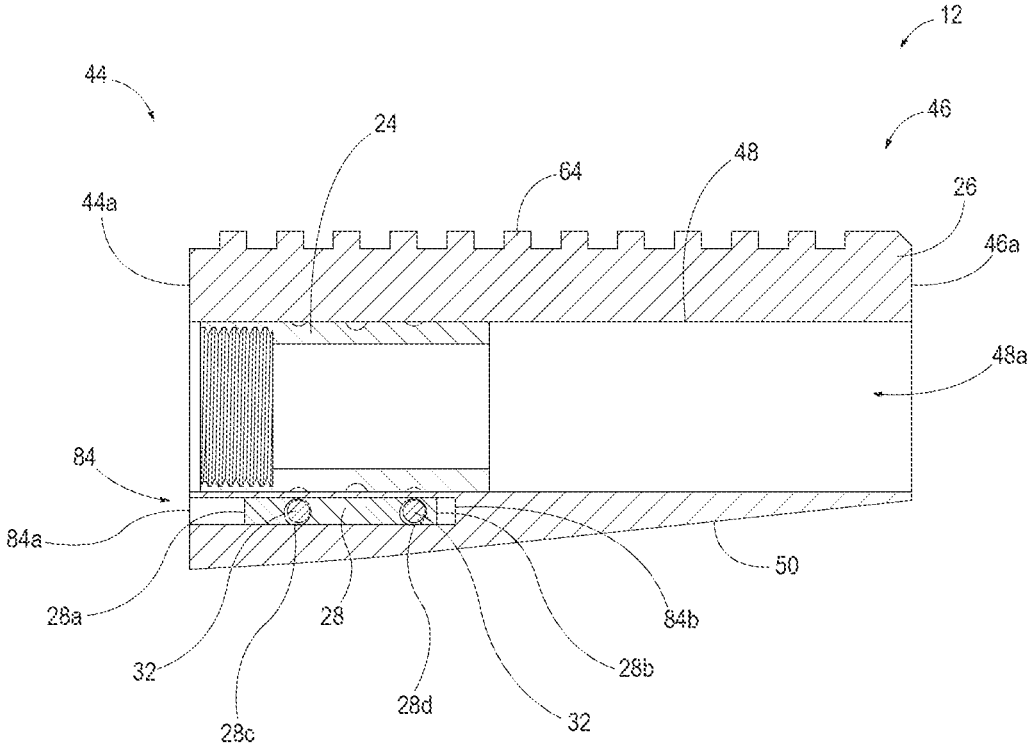
FIG. 7 is a sectional elevation view of FIG. 5 along line 7-7.
Figure 8:
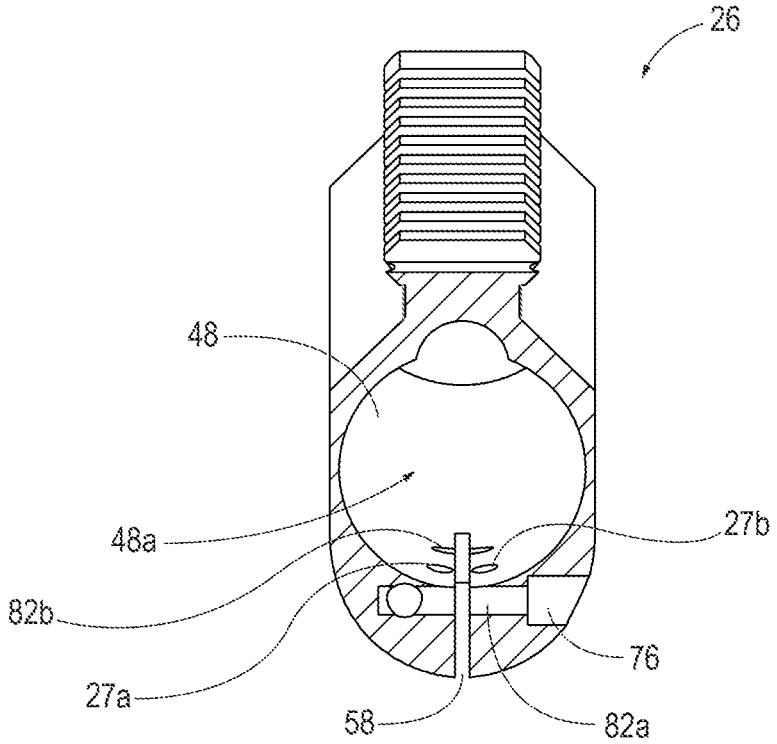
FIG. 8 is a sectional perspective view of FIG. 3 along line 8-8.
Figure 9:
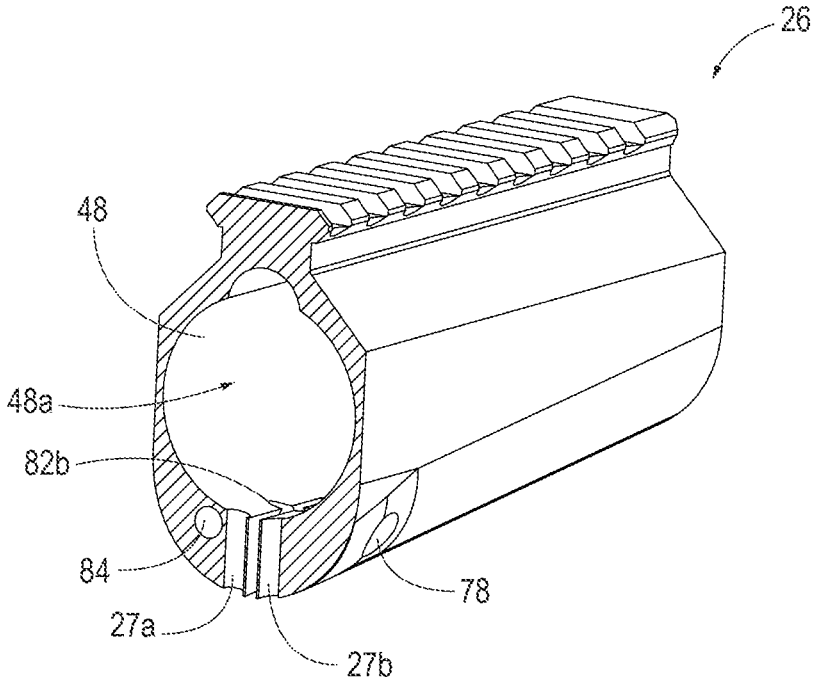
FIG. 9 is a sectional perspective view of FIG. 3 along line 9-9.

However, it will be appreciated that any number of other accessories would be possible, including for example a light or other aiming system. With reference to FIG. 3, the handguard assembly 12 is shown in exploded view. The handguard assembly 12 can include a barrel nut 24, a handguard 26, a key 28, at least one anti-rotation fastener 30, and at least one mounting fastener 32.

The barrel nut 24 can have a cylindrical outer shape and defines an inner diameter 34 and an outer diameter 36. The inner diameter 34 of the barrel nut 24 allows for passage of the barrel 16 of the firearm 10 and the outer diameter 36 is at least partially received in the handguard 26. The barrel nut 24 can be threadably attached to the associated receiver 18 of the associated firearm 10. The barrel nut 24 may be made from any number of materials without departing from the scope of this disclosure. The barrel nut 24 merely needs to be made of a material of sufficient strength to provide a sturdy interface between the receiver 18 and the handguard 26.

The barrel nut 24 can include at least one groove 38. As illustrated, there are a plurality of grooves 38*a*, 38*b*, 38*c* depicted as a front groove 38*a*, a middle groove 38*b*, and a rear groove 38*c* that are longitudinally spaced from one another to extend about the outer diameter 36 of the barrel nut 24 without entirely extending from the outer diameter 36 to the inner diameter 34 such that the middle groove 38*b* is disposed between the front groove 38*a* and the rear groove 38*c*.

Stated another way, the grooves 38*a*, 38*b*, 38*c* are circumferentially disposed about the outer diameter 36 of the barrel nut 24. The front groove 38*a* and the rear groove 38*c* can slidingly receive the at least one mounting fastener 32 that threadingly engages at least one key hole of the key 28. The at least one key hole can include key holes 28*c*, 28*d*.

The at least one anti-rotation fastener 30 can threadingly extend through an at least one anti-rotation bore 27 of the handguard to engage the middle groove 38*b* of the barrel nut 24 as will be described in more detail hereinafter. By having these three grooves 38*a*, 38*b*, 38*c*, the connection between the handguard 26 and the barrel nut 24, and hence the receiver 18 is improved. This improved connection results in a more structurally sound assembly.

With reference to FIGS. 1-9, the handguard 26 is shown. The handguard 26 can also be made from a plurality of materials without departing from the scope of this disclosure. The handguard 26 includes a breech end 44 with a receiver surface 44*a* that faces toward the receiver 18 of the associated firearm 10 and a muzzle end 46 with a muzzle surface 46*a* that faces toward a muzzle 47 of the associated barrel 16 of the associated firearm 10 and in an opposite direction as the receiver surface 44*a*.

As illustrated, the handguard 26 extends between the receiver surface 44*a* and the muzzle surface 46*a* so as to define a longitudinal direction. The handguard 26 also includes an interior surface 48 that faces toward the associated barrel 16 of the firearm 10 and an exterior surface 50 that faces away from the associated barrel 16 and the interior surface 48. The interior surface 48 defines a barrel passageway 48*a* that allows receipt of the associated barrel 16 of the associated firearm 10.

The handguard 26 can also include a first ear 54 and a second ear 56. The first ear 54 can include a first ear inner surface 68 and a first ear outer surface 70 and the second ear 56 can include a second ear inner surface 72. The first ear 54 and the second ear 56, and more particularly the first ear inner surface 68 and the second ear inner surface 73, can be spaced from one another and generally parallel to one another along the longitudinal axis.

The handguard 26, and more particularly the first ear 54, can define at least one anti-rotation bore 27 that extends through the handguard 26. The at least one anti-rotation bore 27 can include a first anti-rotation bore 27*a* and a second anti-rotation bore 27*b* that receive the at least one anti-rotation fastener 30. As illustrated, the at least one anti-rotation fastener 30 can include a first anti-rotation fastener 30*a* and a second anti-rotation fastener 30*b*.

The first anti-rotation bore 27*a* and the second anti-rotation bore 27*b* are in fluid communication with the barrel passageway 48*a*. The anti-rotation fasteners 30*a*, 30*b* can be received in the bores 27*a*, 27*b*, respectively, so as to not protrude from the handguard 26. As illustrated, the anti-rotation fasteners 30*a*, 30*b* are of a set-screw configuration, but other configurations are contemplated and possible.

The first ear inner surface 68 and the second ear inner surface 72 of the first ear 54 and the second ear 56, respectively, cooperate to define a slot 58 that extends in the longitudinal direction. The slot 58 separates the first ear 54 and the second ear 56 from one another and extends from the breech end 44 of the handguard 26 toward the muzzle 47.

The slot 58 may provide for movement of the first ear 54 and the second ear 56 toward and away from one another. This movement allows for a change in the inner diameter of the handguard 26 for interface with the barrel nut 24. Thus, the handguard 26 can be selectively affixed to the barrel nut 24 to prevent rotation of the handguard 26 with respect to the barrel nut 24, and hence the firearm 10.

Further, the second ear 56 of the handguard 26 can define at least one counterbore, and more particularly, a first counterbore 76 and a second counterbore 78 for flush receipt of the first and second mounting fasteners 32 as will be described in more detail hereinafter. Because of the flush receipt of the fasteners 32 in the counterbores 76, 78 any risk of snagging of clothing when deploying the firearm 10 is reduced, thereby improving deployment time.

The handguard 26 defines at least one handguard hole 82 that can be a blind bore. Because the handguard hole 82 is a blind bore, snagging is reduced and a smoother appearance of the handguard assembly 12 is provided. The at least one handguard hole 82 can include a first handguard hole 82*a*, and a second handguard hole 82*b*. Unless otherwise noted, any reference to the at least one handguard hole 82 will be understood to refer to either the first handguard hole 82*a*, the second handguard hole 82*b* or both holes 82*a*, 82*b*. The least one anti-rotation bore 27 can extend through the handguard 26 so as to be orthogonal to the handguard hole 82. This orthogonal layout helps to improve the overall engagement between the handguard 26 and the barrel nut 24.

Further, the at least one counterbore 76, 78 can be in registry with the least one handguard hole 82. The at least one handguard hole 82 extends from the second ear 56 to terminate within the first ear 54. Thus, the at least one handguard hole 82 does not completely extend through the first ear 54. Further, the at least one handguard hole 82 and the barrel passageway 48*a* are in direct fluid communication with one another. Because of this direct fluid communication, the ease of installation of the handguard assembly 12 onto the firearm 10 is improved, as a user can view the orientation of the components when assembly occurs.

The handguard 26 can also include a rail mount bracket 64 as shown in FIGS. 1-2. The rail mount bracket 64 can be disposed on a top side of the handguard 26 that is vertically opposite the first ear 54 and the second ear 56 such that the associated barrel 16 is disposed vertically therebetween. The rail mount bracket 64 extends primarily in the longitudinal direction and is configured for receipt of the accessory 22.

The rail mount bracket 64 may be integral to the handguard 26 and may be of any number of configurations without departing from the scope of this disclosure. For example, it is envisioned that the rail mount bracket 64 could be of a Picatinny rail (also known as MIL-STD-1913 rail or Standardization Agreement 2324 rail) configuration, to act as a standard mounting platform including rails with multiple transverse slots.

Alternatively, and also by way of example, the rail mount bracket 64 could be of a Weaver rail mount configuration. The rail mount bracket 64 can define a tunnel 66 having a tunnel length that extends so as to be generally parallel to the barrel 16 of the firearm 10. Further, the tunnel length is greater than a longitudinal length of the slot 58.

The tunnel 66 can provide for a reduced weight of the handguard 26 and also improved cooling of the associated barrel 16. The tunnel 66 can also provide for the movement of a gas piston (not shown) of the associated firearm 10 as will be understood to one of skill in the art.

The handguard 26, and more particularly the first ear 54 defines a key bore 84 that receives the key 28. The key bore 84 extends in the longitudinal direction from the receiver surface 44*a* toward the muzzle surface 46*a*. Further, the at least one handguard hole 82 and the key bore 84 are disposed within the handguard 26 such that the at least one mounting fastener 32 contacts the barrel nut 24. This contact between the at least one mounting fastener 32 and the barrel nut 24 ensure a rigid connection between the handguard 26 and the firearm 10, thereby ensuring proper operation of the firearm 10.

It is also noted that the key bore 84 is disposed between the interior surface 48 and the exterior surface 50 of the handguard 26. Thus, the key 28 is also disposed between the interior surface 48 and the exterior surface 50. Since the key 28 is completely received within the handguard 26, numerous advantages are provided. For example, the handguard assembly 12 provides a cleaner and aesthetically appealing appearance. Further, there are less areas for that offer a snag opportunity when carrying the firearm 10, thereby improving deployment time of the firearm 10. The key bore includes a port 84*a* that serves as a first point of entry into the key bore 84 and a floor 84*b* that defines an end of the key bore 84. Notably, the floor 84*b* faces the associated receiver 18 and shares a common longitudinal axis with the port 84*a*.

The key 28 can be made of similar or different materials than the barrel nut 24 and the handguard 26. The key 28 is received in the key bore 84 of the handguard 26 so as to be surrounded by the handguard 26 such that the key 28 is concealed from view when the handguard 26 is installed on the associated firearm 10.

The key 28 defines a key length extending in the longitudinal direction and a key diameter. The key length can be greater than the key diameter. Due to these dimensional differences, increased strength is provided by the key 28, and hence attachment of the handguard assembly 12 to the firearm 10 is improved.

The key 28 can also include a receiver face 28*a* that faces the associated receiver 18 and a muzzle face 28*b* that faces the muzzle 47. As illustrated, the muzzle face 28*b* and the receiver face 28*a* face in opposite directions to one another. Further, the key 28 is received in the key bore 84 such that the receiver face 28*a* of the key 28 is longitudinally inset (i.e., toward the muzzle surface 46*a*) from the receiver surface 44*a* of the handguard 26. Because of this arrangement, the handguard assembly 12 has increased flexibility in the installation of a variety of firearms with varying geometry, while still allowing the key 28 to be not visible.

Additionally, the key 28 is received in the key bore 84 such that the muzzle face 28*b* of the key 28 is spaced from the floor 84*b* of the key bore 84 of the handguard 26. The key 28 defines the at least one key hole 28*c*, 28*d* that transversely extends through the key 28 so as to be orthogonal to the longitudinal direction.

The at least one key hole 28*c*, 28*d* is in registry with the at least one handguard hole 82 when the key 28 is received in the key bore 84. The key bore 84 and the barrel passageway 48*a* are not in direct fluid communication with one another but for the at least one handguard hole 82, thereby providing additional material for improved strength of the handguard 26.

The handguard assembly 12 can also include at least one mounting fastener 32. As illustrated, there are a plurality of mounting fasteners 32. The mounting fasteners 32 can be 10-32×½" socket head cap screws. However, it will be understood that any number of mounting fasteners 32 could be utilized without departing from the scope of this disclosure. By utilizing a plurality of mounting fasteners, the connection between the barrel nut 24, the handguard 26, and the key 28 can be ensured.

In view of FIGS. 1-9, installation of the handguard assembly 12 onto the associated firearm 10 will now be described. Initially, a breech end of the barrel 16 can be at least partially inserted into the receiver 18. Then, the barrel nut 24 is slid over the muzzle 47 of the barrel 16 to the receiver 18 and then can be threaded onto the associated receiver 18 of the firearm 10. Next, the handguard 26, with the key 28 completely received therein, can be installed so as to receive the barrel 16 such that the breech end 44 of the handguard 26 is near the receiver 18 and the muzzle surface 46*a* of the handguard 26 is near the muzzle 47 of the barrel 16. Thus, the handguard 26 at least partially surrounds at least part of the barrel nut 24 in a circumferential manner.

Once the handguard 26 is oriented in this manner, the at least one fastener 32 can be inserted into the handguard 26 so as to threadingly engage the key 28 and slidably engage the front groove 38*a* and the rear groove 38*c* of the barrel nut 24. When this occurs, the width of the slot 58 (i.e., the lateral distance between the first ear 54 and the second ear 56 decreases), or stated another way, the slot 58 compresses due to the tightness of the mounting fastener 32.

This also results in an inner diameter of the handguard 26, thereby providing further engagement with the barrel nut 24. Further, the at least one anti-rotation fastener 30 can also be threaded into the handguard 26 so as to engage the middle groove 38*b* of the barrel nut 24.

A handguard assembly has been described above in particularity. Modifications and alternations will occur to those upon reading and understanding the preceding detail description. The invention, however, is not limited to only the embodiment described above. Instead, the invention is broadly defined by the appended claims and the equivalents thereof.

The invention claimed is:

1. A handguard assembly, comprising:

a handguard including a receiver surface that faces toward a receiver of an associated firearm and a muzzle surface that faces toward a muzzle of an associated barrel of the associated firearm and in an opposite direction as the receiver surface, the handguard extending between the receiver surface and the muzzle surface so as to define a longitudinal direction, wherein the handguard defines a key bore extending in the longitudinal direction from the receiver surface toward the muzzle surface, and wherein the handguard defines a barrel passageway that allows receipt of the associated barrel of the associated firearm; and a key received in the key bore of the handguard so as to be surrounded by the handguard such that the key is concealed from view when the handguard is installed on the associated firearm, wherein the key bore is radially spaced from the barrel passageway and separate therefrom.

2. The handguard assembly of claim 1, wherein the key bore is a blind bore.

3. The handguard assembly of claim 1, wherein the key defines at least one key hole that transversely extends through the key so as to be orthogonal to the longitudinal direction.

4. The handguard assembly of claim 3, wherein the handguard defines at least one handguard hole that is in registry with the at least one key hole when the key is received in the key bore.

5. The handguard assembly of claim 4, wherein the at least one key hole threadingly engages at least one mounting fastener that extends through the at least one handguard hole.

6. The handguard assembly of claim 5, wherein the barrel passageway and the at least one handguard hole are in direct fluid communication with one another.

7. The handguard assembly of claim 6, further comprising:

a barrel nut threadably attached to the associated receiver of the associated firearm, wherein the at least one handguard hole and the key bore are disposed within the handguard such that the at least one mounting fastener contacts the barrel nut.

8. The handguard assembly of claim 4, further comprising:

a barrel nut threadably attached to an associated receiver of the associated firearm, the barrel nut defining at least one groove circumferentially disposed about an outer diameter of the barrel nut, wherein the at least one groove slidingly receives at least one mounting fastener that threadingly engages the key.

9. The handguard assembly of claim 8, wherein the at least one groove includes a front groove and a rear groove, with a middle groove disposed therebetween, the front groove, the middle groove, and the rear groove being longitudinally spaced from one another.

10. The handguard assembly of claim 9, wherein the handguard defines at least one anti-rotation bore that extends through the handguard so as to be orthogonal to the handguard hole, and wherein the handguard assembly includes at least one anti-rotation fastener that threadingly extends through the at least one anti-rotation bore to engage the middle groove of the barrel nut.

11. The handguard assembly of claim 4, wherein the handguard includes a first ear with a first ear inner surface and a second ear with a second ear inner surface cooperating to define a slot that extends in the longitudinal direction, and wherein the first ear defines the key bore and the second ear defines at least one counterbore that is in registry with the least one handguard hole.

12. The handguard assembly of claim 11, wherein the least one handguard hole is a blind bore.

13. The handguard assembly of claim 4, wherein the handguard includes a first ear and a second ear cooperating to define a slot that extends in the longitudinal direction, and wherein the least one handguard hole extends from the second ear to terminate within the first ear and not completely extend through the first ear.

14. The handguard assembly of claim 1, wherein the key includes a receiver face that faces the associated receiver and a muzzle face that is opposite the receiver face, and wherein the key is received in the key bore such that the receiver face of the key is inset from the receiver surface such that a longitudinal distance between the receiver face and the associated receiver is greater than a longitudinal distance between the associated receiver and the receiver surface.

15. The handguard assembly of claim 1, wherein the key includes a muzzle face that faces the associated muzzle and a receiver face that is opposite the receiver face, and wherein the key is received in the key bore such that the muzzle face of the key is longitudinally spaced from a floor of the bore hole of the handguard.

16. The handguard assembly of claim 1, wherein the handguard includes an interior surface that defines the barrel passageway and an exterior surface that faces away from the interior surface, and wherein the key bore is disposed between the interior surface and the exterior surface.

17. The handguard assembly of claim 1, wherein the key bore includes a port that serves as a first point of entry into the key bore and a floor that defines an end of the key bore, and wherein floor faces the associated receiver and shares a common longitudinal axis with the port.

18. The handguard assembly of claim 1, wherein the key defines a key length extending in the longitudinal direction and a key diameter, wherein the key length is greater than the key diameter.

19. A handguard assembly, comprising:

a handguard including a receiver surface that faces toward a receiver of an associated firearm and a muzzle surface that faces toward a muzzle of an associated barrel of the associated firearm and in an opposite direction as the receiver surface, the handguard extending between the receiver surface and the muzzle surface so as to define a longitudinal direction, wherein the handguard defines a key bore extending in the longitudinal direction from the receiver surface toward the muzzle surface; and a key received in the key bore of the handguard so as to be surrounded by the handguard such that the key is concealed from view when the handguard is installed on the associated firearm, wherein the handguard defines a barrel passageway that allows receipt of the associated barrel of the associated firearm, and wherein the handguard includes a first ear and a second ear cooperating to define a slot that extends in the longitudinal direction, and wherein the first ear of the handguard defines a first anti-rotation bore and the second ear of the handguard defines a second anti-rotation bore, the first anti-rotation bore and the second anti-rotation bore being in fluid communication with the barrel passageway.

20. A handguard assembly, comprising:

a handguard including a receiver surface that faces toward a receiver of an associated firearm and a muzzle surface that faces toward a muzzle of an associated barrel of the associated firearm and in an opposite direction as the receiver surface, the handguard extending between the receiver surface and the muzzle surface so as to define a longitudinal direction, wherein the handguard defines a key bore extending in the longitudinal direction from the receiver surface toward the muzzle surface; and a key received in the key bore of the handguard so as to be surrounded by the handguard such that the key is concealed from view when the handguard is installed on the associated firearm, wherein the key defines at least one key hole that transversely extends through the key so as to be orthogonal to the longitudinal direction and the handguard defines at least one handguard hole that is in registry with the at least one key hole when the key is received in the key bore, wherein the handguard defines a barrel passageway that allows receipt of the associated barrel of the associated firearm, and wherein the key bore and the barrel passageway are not in direct fluid communication with one another but for the at least one handguard hole.

* * * * *